US007149458B2

(12) United States Patent
Zona et al.

(10) Patent No.: US 7,149,458 B2
(45) Date of Patent: Dec. 12, 2006

(54) XEROGRAPHIC CHARGING DEVICE HAVING THREE PIN ARRAYS

(75) Inventors: Michael F. Zona, Holley, NY (US); Alicia G. Hughes, Penfield, NY (US); Allen J. Thompson, Sodus, NY (US); Neil A. Frankel, Rochester, NY (US); Charles H. Tabb, Rochester, NY (US); Clifford W. Imes, IV, Rochester, NY (US); George E. Wright, Rochester, NY (US); Eugene M. Gluszko, Webster, NY (US)

(73) Assignee: Xerox Corporation, Stamford, CT (US)

( * ) Notice: Subject to any disclaimer, the term of this patent is extended or adjusted under 35 U.S.C. 154(b) by 143 days.

(21) Appl. No.: 11/068,357

(22) Filed: Feb. 28, 2005

(65) Prior Publication Data

US 2006/0193657 A1 Aug. 31, 2006

(51) Int. Cl.
*G03G 15/02* (2006.01)

(52) U.S. Cl. ..... 399/170; 250/324; 250/325; 399/171; 399/173

(58) Field of Classification Search ..... 399/170, 399/171, 172, 173, 311; 250/324, 325, 326; 361/225
See application file for complete search history.

(56) References Cited

U.S. PATENT DOCUMENTS 3,038,073 A * 6/1962 Johnson ..... 250/325
3,708,661 A * 1/1973 Hansen et al. ..... 250/324
3,800,153 A * 3/1974 Matsumoto et al. ..... 250/325
3,843,906 A * 10/1974 Leibrecht ..... 250/324 X
3,967,118 A * 6/1976 Sternberg ..... 250/325
4,386,837 A * 6/1983 Ando ..... 399/171 X
4,408,865 A * 10/1983 Camis et al. ..... 399/170
4,558,221 A * 12/1985 Gundlach et al. ..... 250/325
5,181,026 A * 1/1993 Granville ..... 340/870.28
5,742,871 A * 4/1998 May et al. ..... 250/324 X
5,742,874 A * 4/1998 Koshimura et al. ..... 399/173 X
5,845,179 A 12/1998 Damji et al. ..... 399/173
6,459,873 B1 10/2002 Song et al. ..... 399/171
6,553,198 B1 * 4/2003 Slattery et al. ..... 399/171
6,823,157 B1 11/2004 Foltz ..... 399/171
7,043,176 B1 * 5/2006 DeHollander et al. ..... 399/170
2001/0046394 A1 * 11/2001 Yamanaka et al. ..... 399/170
2006/0013617 A1 * 1/2006 Facci et al. ..... 399/171
2006/0018682 A1 * 1/2006 Nooyens et al. ..... 399/170

FOREIGN PATENT DOCUMENTS

JP 02-273762 A * 11/1990

* cited by examiner

*Primary Examiner*—Sophia S. Chen
(74) *Attorney, Agent, or Firm*—R. Hutter

(57) ABSTRACT

In a xerographic printing apparatus, a scorotron places a uniform charge on a photoreceptor for forming electrostatic latent images. Three conductive pin arrays are disposed in a housing defined by sidewalls and a screen adjacent the photoreceptor. There can be provided insulative walls between adjacent pin arrays. The screen and a surface of the housing can be curved to correspond to a curvature of the photoreceptor.

19 Claims, 4 Drawing Sheets

XEROGRAPHIC CHARGING DEVICE HAVING THREE PIN ARRAYS

TECHNICAL FIELD

The present disclosure relates to a charging device used in electrostatographic printing or xerography.

BACKGROUND

In the well-known process of electrostatographic or xerographic printing, an electrostatic latent image is formed on a charge-retentive imaging surface, typically a "photoreceptor," and then developed with an application of toner particles. The toner particles adhere electrostatically to the suitably-charged portions of the photoreceptor. The toner particles are then transferred, by the application of electric charge, to a print sheet, forming the desired image on the print sheet. An electric charge can also be used to separate or "detack" the print sheet from the photoreceptor.

For the initial charging, transfer, or detack of an imaging surface, the most typical device for applying a predetermined charge to the imaging surface is a "corotron," of which there are any number of variants, such as the scorotron or dicorotron. Common to most types of corotron is a bare conductor, in proximity to the imaging surface, which is electrically biased and thereby supplies ions for charging the imaging surface. The conductor typically comprises one or more corona members, such as wires (often called a "corona wire") or a metal bar forming saw-teeth (a "pin array"), the conductor extending parallel to the imaging surface and along a direction perpendicular to a direction of motion of the imaging surface. Other structures, such as a screen, conductive shield and/or nonconductive housing, are typically present in a charging device, and some of these may be electrically biased as well. A corotron having a screen or grid disposed between the conductor and the photoreceptor is typically known as a "scorotron".

PRIOR ART

U.S. Pat. No. 5,845,179 discloses design rules for a corotron, with the objective of minimizing ozone production.

U.S. Pat. No. 6,459,873 discloses a xerographic charging apparatus having two independently-controllable scorotrons.

U.S. Pat. No. 6,823,157 discloses a xerographic scorotron with a curved grid.

SUMMARY

There is provided an electrostatographic printing apparatus, comprising a charge receptor and a charge device for applying a charge to a surface of the charge receptor. The charge device includes three corona members.

According to another aspect, there is provided a charge device suitable for electrostatographic printing, comprising a block, and three corona members extending from a main surface of the block, each corona member including a pin array. An insulative wall is disposed between each adjacent pair of corona members.

According to another aspect, there is provided a charge device suitable for electrostatographic printing, comprising a block, and three corona members extending from a main surface of the block, each corona member including a pin array. The main surface of the block defines a curvature.

DETAILED DESCRIPTION

Figure 1:
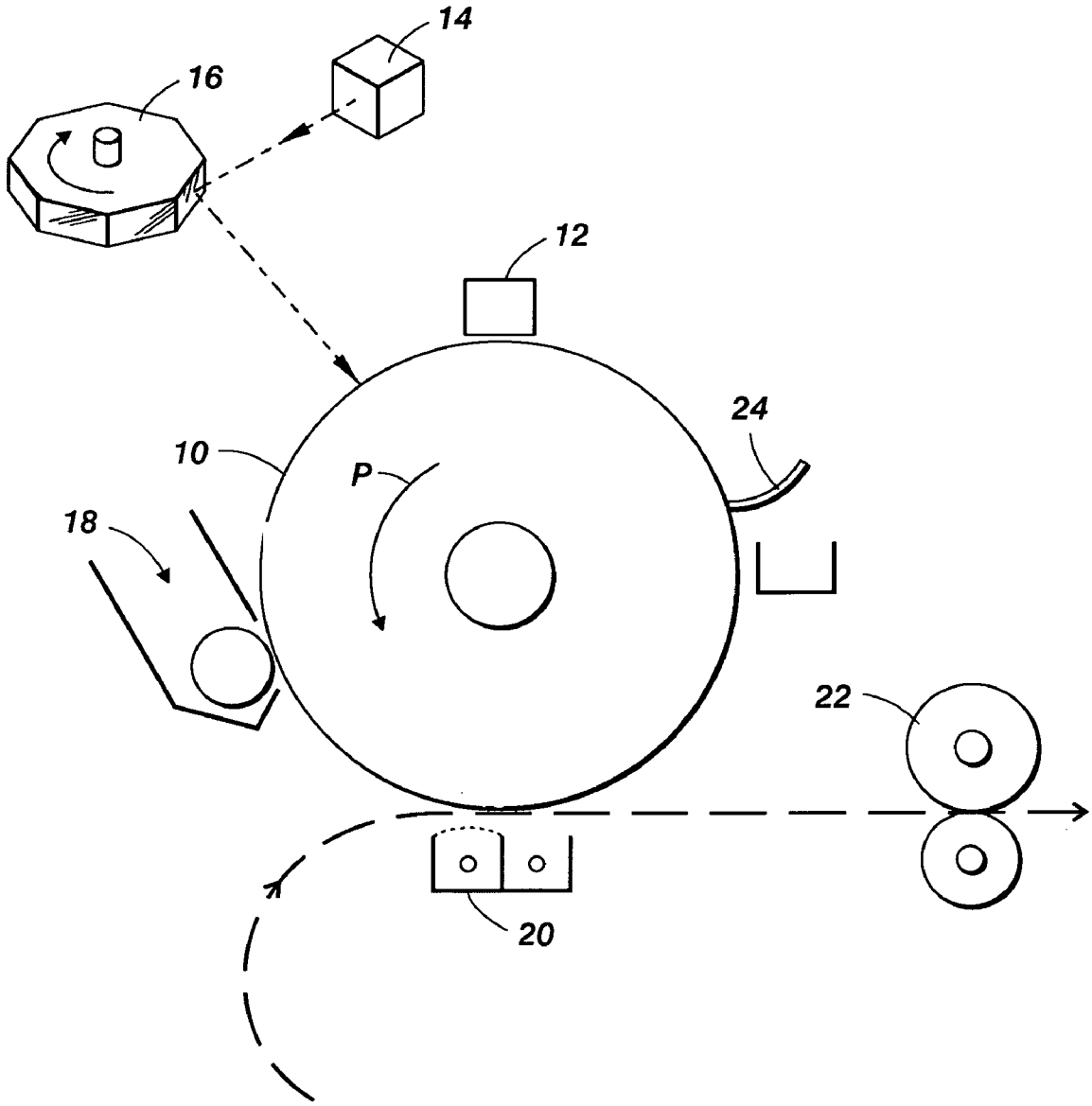
FIG. 1 PRIOR ART
FIG. 1 is an elevational view showing elements of a electrostatographic or xerographic printer.

FIG. 1 is an elevational view showing elements of a electrostatographic or xerographic printer, such as a copier or a "laser printer". There is provided in the printer a charge receptor such as photoreceptor 10, which may be in the form of a belt or drum, and which defines a charge-retentive surface for forming electrostatic images thereon. The photoreceptor 10 is caused to rotate through process direction P.

The first step in the process is the general charging of the relevant photoreceptor surface. This initial charging is performed by a charge device indicated as 12, to impart an electrostatic charge on the surface of the photoreceptor 10 moving past it. The charged portions of the photoreceptor 10 are then selectively discharged in a configuration corresponding to the desired image to be printed, by a raster output scanner or ROS, which generally comprises a laser source 14 and a rotatable mirror 16 which act together, in a manner known in the art, to discharge certain areas of the surface of photoreceptor 10 according to a desired image to be printed. Although the FIG. shows a laser 14 to selectively discharge the charge-retentive surface, other apparatus that can be used for this purpose include an LED bar, or, in a copier, a light-lens system. The laser source 14 is modulated (turned on and off) in accordance with digital image data fed into it, and the rotating mirror 16 causes the modulated beam from laser source 14 to move in a fast-scan direction perpendicular to the process direction P of the photoreceptor 10.

After certain areas of the photoreceptor 10 are discharged by the laser source 14, the remaining charged areas are developed by a developer unit such as 18, causing a supply of dry toner to contact or otherwise approach the surface of photoreceptor 10. The developed image is then advanced, by the motion of photoreceptor 10, to a transfer station 20, which causes the toner adhering to the photoreceptor 10 to be electrically transferred to a print sheet, which is typically a sheet of plain paper, to form the image thereon. The sheet of plain paper, with the toner image thereon, is then passed through a fuser 22, which causes the toner to melt, or fuse, into the sheet of paper to create the permanent image. Any residual toner remaining on the photoreceptor 10 can be removed by cleaning blade 24 or equivalent device.

Although a monochrome xerographic print engine is shown in FIG. 1, the above-described elements would be apparent in a color engine, whether such an engine included a single photoreceptor with multiple exposure and development devices, or multiple photoreceptors each transferring toner images onto a common intermediate transfer belt; the present disclosure is applicable to such color devices as well.

Figure 2:
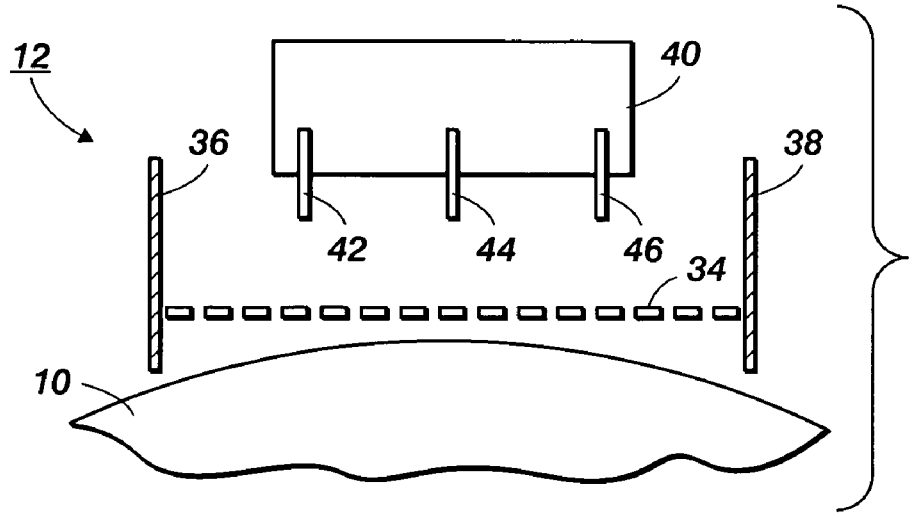
FIG. 2 is an elevational, sectional view of one embodiment of a three-array scorotron.
Figure 7:
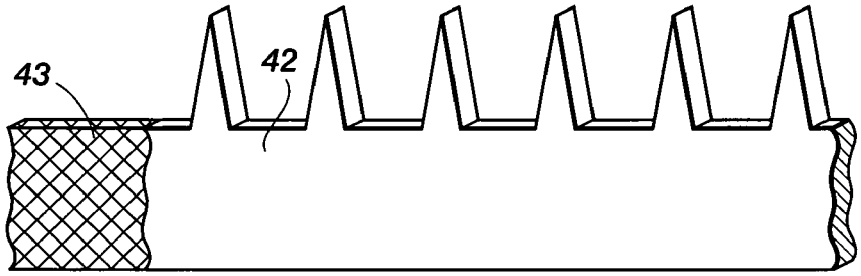
FIG. 7 is an elevational view, orthogonal to the view of FIG. 2, of a portion of a single pin array, in isolation.
Figure 8:
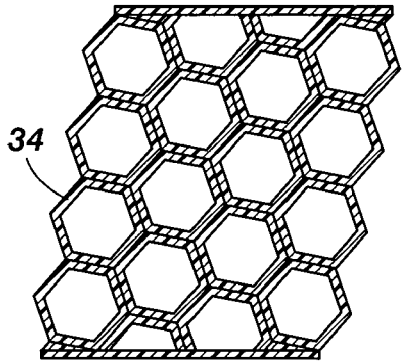
FIG. 8 is a plan view of a grid used in a scorotron such as in FIG. 2.

FIG. 2 is an elevational view of a first embodiment of a charge device, in this case a scorotron, such as 12. The charge device 12 includes basic elements generally familiar in xerographic charge devices: a grid or screen 34, side walls 36, 38, and an insulative block 40 in which are partially embedded three pin arrays, 42, 44, 46. Each pin array, in one embodiment, defines a set of teeth, or pins, that are generally directed toward the photoreceptor 10; an orthogonal view of one possible embodiment of a pin array, such as 42, is shown as FIG. 7. An orthogonal view of one possible embodiment of a screen 34 is shown at FIG. 8.

Although pin arrays are shown in the illustrated embodiments, such pin arrays are embodiments of what can be more broadly called "corona members," meaning any member that is capable of outputting charge when electricity is applied thereto. Other examples of corona members include wires or plates. In the context of an electrostatographic printer having a movable charge receptor, the corona members are shaped to extend perpendicular to the process direction P of the charge receptor.

In the FIG. 2 embodiment, the adjacent pin arrays are spaced about 8 mm apart, and the distance between sidewalls 36, 38 is about 38 mm. As mounted in a printing apparatus with a drum-type photoreceptor 10, the screen 34 is disposed about 1 mm from the closest surface of photoreceptor 10. Further as can be seen in FIG. 2, the sidewalls 36, 38 may be spaced some distance from the block 40, such as to allow an airflow therethrough. Also, the presence of screen 34 is optional depending on a specific design.

Figure 3:
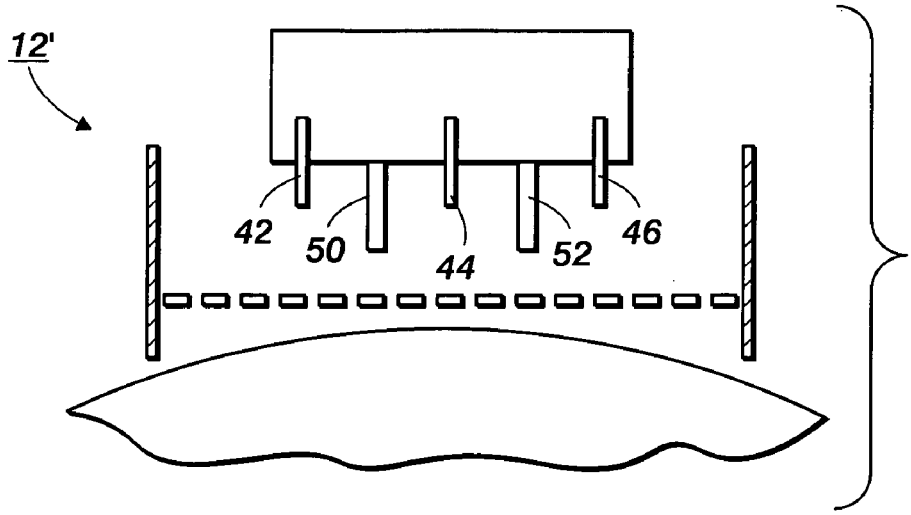
FIG. 3 is an elevational, sectional view of another embodiment of a three-array scorotron.

FIG. 3 is an elevational view of a second embodiment of a charge device, indicated as 12'. The charge device 12' is identical to the embodiment in FIG. 2, with the addition of substantially insulative walls 50, 52. The walls 50, 52, are disposed generally near the outer pin arrays 42, 46, and can extend slightly longer than the pin arrays, as shown. The specific dimensions and positions of the walls 50, 52 are chosen to obtain a desirable distribution of applied current between each of the three pin arrays 42, 44, 46 to provide uniform charge as needed on the photoreceptor 10. The lower tip of the insulative walls 50, 52 can extend approximately one to two millimeters beyond the tips of the outside pin arrays 42, 46 and be spaced two to four millimeters from each of the outside arrays in the process direction.

Figure 4:
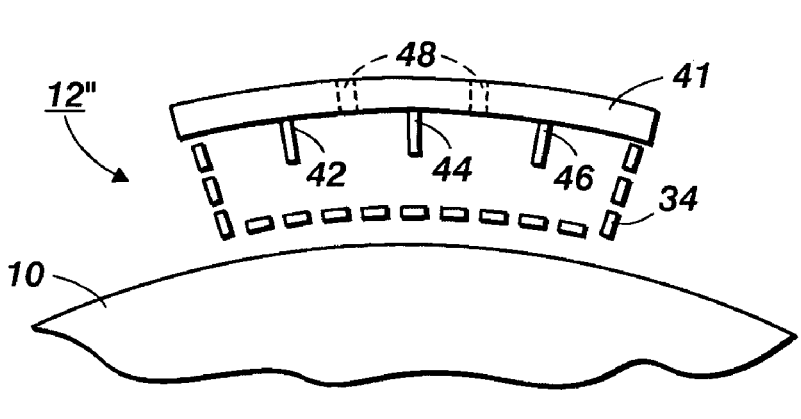
FIG. 4 is an elevational, sectional view of another embodiment of a three-array scorotron.

FIG. 4 is an elevational view of a third embodiment of a charge device, indicated as 12". The charge device 12" is identical to the embodiment in FIG. 2, except that the insulative block, here indicated as 41, in which the pin arrays 42, 44, 46 are embedded, is curved to approximate the curvature of the adjacent portion of photoreceptor 10. The curvature of block 41 also allows each pin array 42, 44, 46 to be oriented approximately normally to the closest surface of photoreceptor 10. In this embodiment, the screen 34 can be curved as well to approximate the curvature of the adjacent portion of photoreceptor 10. Block 41 can further define one or more openings such as 48 to assist in passage of air therethrough.

Figure 5:
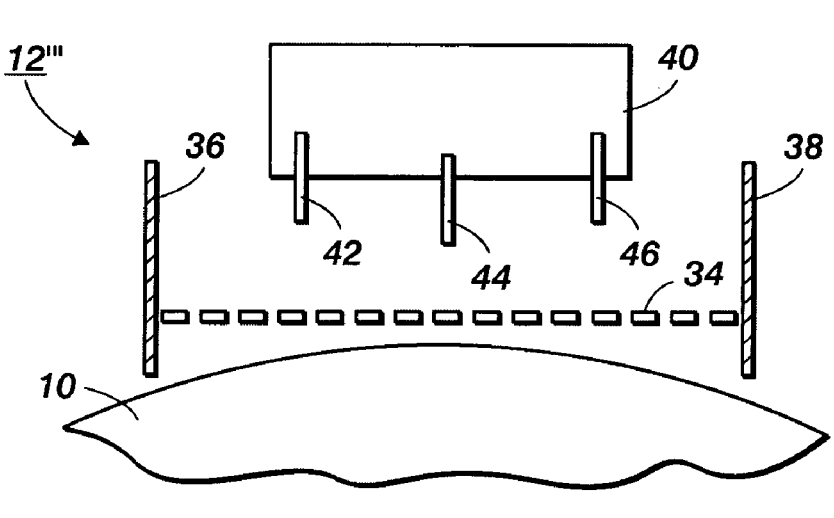
FIG. 5 is an elevational, sectional view of another embodiment of a three-array scorotron.

FIG. 5 is an elevational view of the fourth embodiment of a charge device, indicated as 12'". The charge device 12'" is identical to the embodiment in FIG. 2, except that the center pin array 44 is one to two millimeters closer to the screen 34. The smaller pin to screen distance in the center of the device is chosen to obtain a desirable distribution of applied current between each of the three pin arrays 42, 44, 46 to provide uniform charge as needed on the photoreceptor 10.

Figure 6:
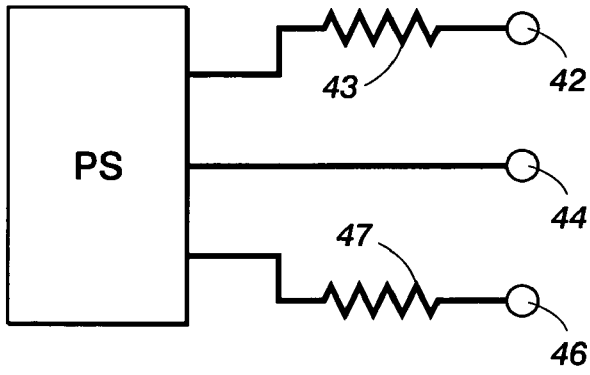
FIG. 6 is simplified schematic view of power connections to pin arrays in scorotron.

In any of the embodiments of FIGS. 2–5, in order to obtain a desirable distribution of charge on photoreceptor 10, one strategy is to provide different electrical properties or inputs to different pin arrays 42, 44, 46. FIG. 6 is a simplified schematic view of one possible embodiment, in which the "outer" pin arrays 42, 46 (i.e., the first and last pin arrays along the process direction of the photoreceptor 10) are placed in series with known resistances, 43 and 47 respectively. In one practical embodiment, the additional resistors make a distribution of a common current to all three arrays more uniform. Fine manipulation of electrical power to the arrays may be useful in printer designs where the middle pin array 44 is disposed closer to the photoreceptor 10 than the outer pin arrays 42, 46.

Also, in one embodiment, the additional resistances such as 43 can be provided by flexible circuitry resistors, or rigid carbon film resistors associated with the respective pin arrays. An example of such a resistor is shown in the orthogonal view of FIG. 7. where a resistance 43 is attached to a pin array such as 42. The flexible circuitry forming resistance 43 could be specifically designed for particular electrical requirements such as resistance, or impedance, and be sized relative to the metal forming the pin array to prevent excessive heat generation or voltage drops. The flexible circuitry forming resistance 43 provides good application to corotron design because of its ability to fold around plastic moldings when dealing with space constraints. The flexible circuitry can be terminated directly to connectors, and provides effective heat dissipation and sinking to increase the thermal capability.

Although the above detailed description relates to a device for placing an initial charge on a charge receptor at the beginning of an electrostatographic printing process, charge devices as described in the claims can apply to other functions related to electrostatographic printing, such as ionographic image exposure, transfer of marking material from the charge receptor to a print sheet, or detacking of print sheets from the charge receptor.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An electrostatographic printing apparatus, comprising:

a charge receptor;

a screen defining a surface substantially approximating a curvature of the charge receptor; and a charge device for applying a charge to a surface of the charge receptor, the charge device including three corona members, a middle corona member of the three corona members having a portion disposed closer to the screen than a portion of either outer corona member.

2. The apparatus of claim 1, at least one of the corona members including a pin array.

3. The apparatus of claim 1, the charge receptor being movable in a process direction, and the three corona members extending substantially perpendicular to the process direction.

4. The apparatus of claim 3, each of the three corona members including a pin array.

5. The apparatus of claim 4, each of the three corona members being oriented so that the pin array thereon is substantially normal to a closest surface of the charge receptor.

6. The apparatus of claim 1, the middle corona member being not more than 2 mm closer to the screen than a portion of either outer corona member.

7. The apparatus of claim 1, each of the corona members including a pin array.

8. The apparatus of claim 1, wherein each of the three corona members are commonly connected to a power source, and further comprising a predetermined resistance associated with at least one corona member.

9. The apparatus of claim 8, the predetermined resistance including a flexible resistance member.

10. The apparatus of claim 8, wherein each of the three corona members are commonly connected to a power source, and further comprising a predetermined resistance associated with each of a first corona member and last corona member relative to a process direction of the charge receptor.

11. The apparatus of claim 1, further comprising a block, the three corona members being partially embedded in the block.

12. The apparatus of claim 11, the block defining an opening therethrough suitable for airflow.

13. The apparatus of claim 11, the block defining a surface substantially approximating a curvature of the charge receptor.

14. The apparatus of claim 13, further comprising the screen disposed between the corona members and the charge receptor.

15. The apparatus of claim 1, each of the three corona members defining a pin array, and further comprising a block, the three corona members being partially embedded in the block, the block defining a surface substantially approximating a curvature of the charge receptor; and the screen disposed between the corona members and the charge receptor.

16. An electrostatograhic printing apparatus, comprising:

a charge receptor; and a charge device for applying a charge to a surface of the charge receptor, the charge device including three corona members;

a wall disposed between a first corona member and a second corona member of the three corona members, the wall extending not more than 2 mm longer than the first corona member or the second corona member.

17. The apparatus of claim 16, the wall being substantially non-conductive.

18. The apparatus of claim 16, each of the first corona member and second corona member including a pin array.

19. The apparatus of claim 16, further comprising a wall disposed between a second corona member and a third corona member.

* * * * *